US005186014A

United States Patent [19]

Runk

[11] Patent Number: 5,186,014

[45] Date of Patent: Feb. 16, 1993

[54] LOW REFRIGERANT CHARGE DETECTION SYSTEM FOR A HEAT PUMP

[75] Inventor: Robert M. Runk, Gasport, N.Y.

[73] Assignee: General Motors Corporation, Detroit, Mich.

[21] Appl. No.: 912,374

[22] Filed: Jul. 13, 1992

[51] Int. Cl.[5] ..... F25B 49/00

[52] U.S. Cl. ..... 62/129; 62/160

[58] Field of Search ..... 62/129, 125, 126, 127, 62/158, 160

[56] References Cited

U.S. PATENT DOCUMENTS

| | | | |
|---|---|---|---|
| 4,167,358 | 9/1979 | Kojima et al. | 62/126 |
| 4,220,010 | 9/1980 | Mueller et al. | 62/126 |
| 4,265,091 | 5/1981 | Kobayashi | 62/126 |
| 4,677,830 | 7/1987 | Sumikawa et al. | 62/126 |
| 4,745,765 | 5/1988 | Pettitt | 62/129 |
| 5,009,074 | 4/1991 | Goubeaux et al. | 62/129 |
| 5,009,076 | 4/1991 | Winslow | 62/129 |
| 5,044,168 | 9/1991 | Wycoff | 62/126 |

FOREIGN PATENT DOCUMENTS 148611 11/1980 Japan .

*Primary Examiner*—Harry B. Tanner

*Attorney, Agent, or Firm*—Patrick M. Griffin

[57] ABSTRACT

A low refrigerant charge detector is operatively connected in either the suction or discharge line of a compressor of a heat pump system, wherein the compressor is in turn connected to a reversing valve. The detector includes a pressure sensor connected in one line and transmits pressure readings to a computer. During reversal of the flow of liquid in the system by the reversing value, the time at which the pressure exceeds or drops below a predetermined value is measured. The comparison depends on if the sensor is connected in the suction line or discharge line. If the time exceeds a minimum time, a low charge of refrigerant is indicated.

3 Claims, 2 Drawing Sheets

LOW REFRIGERANT CHARGE DETECTION SYSTEM FOR A HEAT PUMP

TECHNICAL FIELD

The invention relates to a method of determining the loss of refrigerant charge in heat pump systems, and more particularly to determining the loss of refrigerant by sensing pressure of the refrigerant flowing in the system.

BACKGROUND OF THE INVENTION

Heat pump systems may lose refrigerant charge by either leaks or component failure. It has been known to determine a loss of refrigerant charge by utilizing a trained technician who measures the superheat of the system using a specific procedure. There exists an acceptable range of values that are provided by the manufacturer to determine the loss of refrigerant. When the values are outside of this range, the system is low on refrigerant charge. Charge is added until the values fall in the proper range. A loss of charge is normally not checked for or analyzed until the system has a noticeable performance problem that causes consumer dissatisfaction. It has been desirable to determine the status of refrigerant charge in systems before there is this noticeable problem.

U.S. Pat. No. 5,044,168 issued Sept. 3, 1991 in the name of Wycoff discloses a method of low refrigerant charge detection. Separate pressure transducers are installed to measure the suction and discharge pressures of the compressor in the refrigeration system. When the compressor is shut off, the pressure difference between the discharge and suction pressures is measured by a microprocessor-based controller. A low refrigerant alarm or indicator is activated if the pressure difference is below a predetermined value programmed in the controller. The difference calculation could be invalid in low refrigerant load conditions when the suction and discharge pressure differences are small already.

U.S. Pat. No. 4,677,830 issued Jul. 7, 1987 in the name of Sumikawa et al. discloses an air conditioning system for vehicles to detect low refrigerant. The temperature and pressure of refrigerant at the outlet of the evaporator are detected by a temperature sensor and pressure sensor. The pressure of refrigerant detected by the pressure sensor is converted by conversion means into a corresponding saturation temperature of the refrigerant. Determining means determines whether or not the refrigerant quantity is insufficient by comparing the difference between the refrigerant temperature and the corresponding saturation temperature of the refrigerant with a predetermined reference value. Indicator means indicates abnormality when the refrigerant quantity is determined to be insufficient. If this system was applied to a heat pump, two pressure sensors and two temperature sensors would be required to handle the evaporator discharges in both heating and cooling inside.

U.S. Pat. No. 5,009,076 issued Apr. 23, 1991 in the name of Winslow discloses a refrigerant loss monitor. The monitor monitors a number of variables within the refrigerant's circuit, including environmental and refrigerant conditions, and arrives at expected refrigerant conditions utilizing the sensed environmental conditions. A pressure sensor in the compressor discharge line and a pressure sensor at either the evaporator outlet or compression suction line are measured. A computer based system compares these values to monitor refrigerant loss.

SUMMARY OF THE INVENTION

The invention is a method of detecting low refrigerant charge in a heat pump system of the type having a compressor operatively connected to a reversing valve. The method includes the steps of sensing the pressure of the refrigerant at a fluid line of the compressor which is connected to the reversing valve, detecting the time period that the sensed pressure exceeds or drops below i.e., crosses a predetermined pressure in response to reversal of the fluid flow direction by reversing the reversing valve, and indicating the low refrigerant charge in the heat pump system when the time period has a predetermined relationship to a predetermined time.

The invention also includes a detection apparatus for detecting low refrigerant charge in a heat pump system of the type having a compressor operatively connected by fluid lines to a reversing valve, and including an evaporator and expansion device and condenser. The apparatus comprises pressure sensing means operatively connected to a fluid line of the compressor for sensing the pressure of refrigerant flowing in the fluid line to produce a pressure signal indicative thereof, pressure means for receiving the pressure signal and for detecting the time period that the sensed pressure exceeds or drops below a predetermined pressure in response to reversal of the fluid flow direction by reversing the reversing valve and for producing a warning signal, and indicating means for receiving the warning signal and for producing an indication of low refrigerant charge when the time period is less than a predetermined time.

BRIEF DESCRIPTION OF THE DRAWINGS

Advantages of the invention will be readily appreciated as the same become better understood when taken in conjunction with the following drawings wherein.

DETAILED DESCRIPTION OF THE PREFERRED EMBODIMENT

Figure 1:
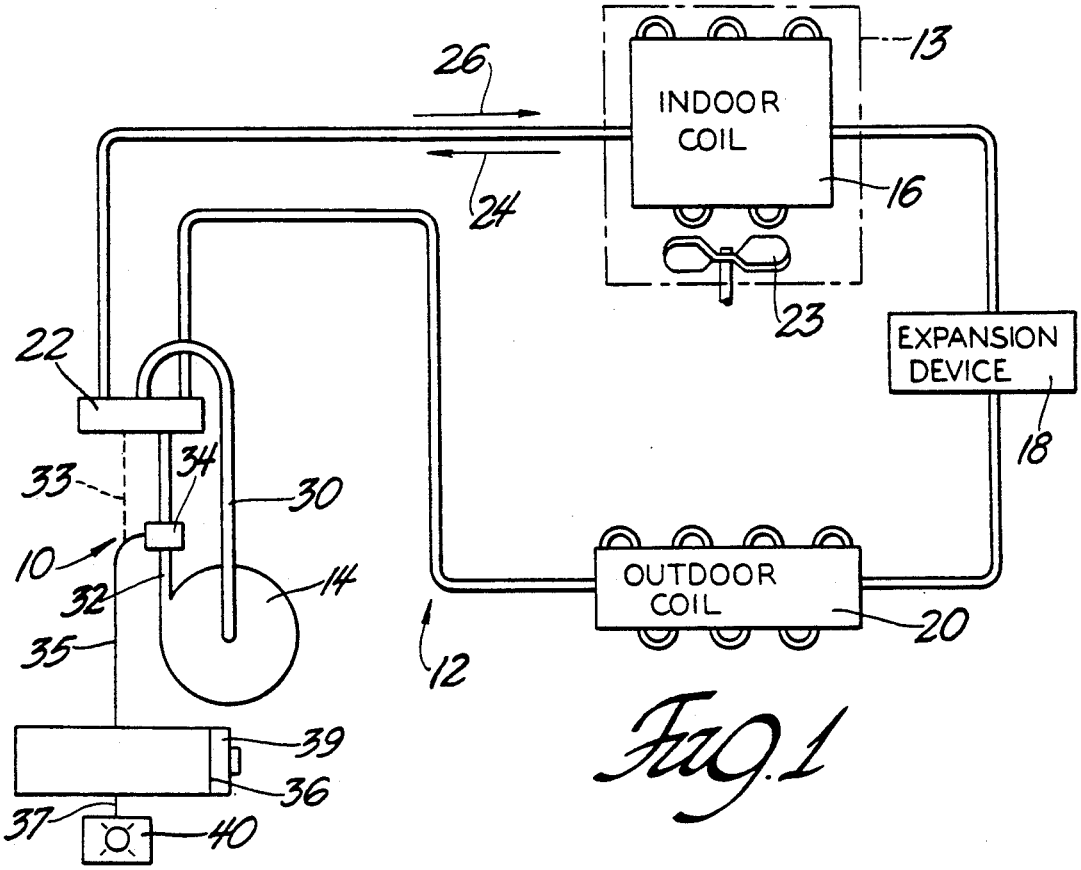
FIG. 1 is a block diagram of the subject invention.

A detection apparatus for detecting low refrigerant charge in a heat pump system 12 is generally indicated at 10 in FIG. 1. As commonly known in the art, the heat pump system 12 generally includes a compressor 14 connected to a reversing valve 22, which is in turn connected to a first heat exchanger 16, which is in turn connected to an expansion device 18, and is in turn connected to a second heat exchanger 20 and back to the reversing valve 22. The first and second heat exchangers 16,20 interchangeably function as an evaporator and condenser depending on the direction of fluid flow in the system 12. The components act in the manner commonly known in the art. In an automotive application, the indoor coil 16 is associated with a blower 23 that will circulate air across the indoor coil 16 to either heat or cool the area depending on whether the reversing valve 22 is positioned in a cool or heat mode of operation.

During cold weather, the heat pump system 12 flows in a first direction indicated by the arrow 26 in order to heat an area 13, and during warm weather the reversing valve 22 will be reversed to provide flow in the direction of arrow 24 in order to provide cooling to the area 13. The compressor 14 includes a suction line 30 and discharge line 32, both of which are connected to the reversing valve 22.

The detection apparatus 10 includes a pressure transducer or sensor 34 connected in one of the compressor lines 30,32. FIG. 1 illustrates the pressure sensor 34 connected in the discharge line 32. The pressure sensor 34 produces a pressure signal indicative of the pressure in the discharge line 32. The pressure transducer 34 may be a simple switch or transducer, such as, Texas Instruments supplied GM Part Number 22536559.

The detection apparatus 10 also includes a computer or controller 36, which may be of any type commonly available. The computer 36 receives the pressure signals from the pressure transducer 34 on line 35 and determines whether or not there is a loss of refrigerant charge. The determination of loss of refrigerant occurs during a test mode in which the blower 23 is off or put on low speed to minimize compartment heating during warm weather or excessive cooling during cold weather. The test mode occurs during defrost cycles in cold weather or for a short time just before cycling off in warm weather by shifting the reversing valve 22 to heating mode. The switching of the valve 22 may be manually controlled by an external operator commonly known in the art, or may be remotely controlled by a signal from the computer 32 on control line 33. The signal is produced when a test mode switch 35 is operated.

The apparatus 10 works on the principles that during any reversing valve position change, the suction and head pressure of the compressor 14 undergo a momentary change in value until the pressures in the heat pump system 12 restabilize in a new mode. The rate of change of the pressure fluctuation is an indication of the relative amount of charge in the system 12. A system 12 that is low on refrigerant charge will have a lower amount of refrigerant in the liquid state on the low pressure side of the expansion device 18. Accordingly, it will take less time to pump that liquid refrigerant to the other side of the expansion device 18 when the system is low on charge. The system pressure will restabilize sooner, and the pressure fluctuation period will be shorter.

Indicating means 40 receives a warning signal from the computer 36 on line 37 and produces an indication of low refrigerant charge. The indication means 40 may be a warning light, as illustrated in FIG. 1.

Figure 3:
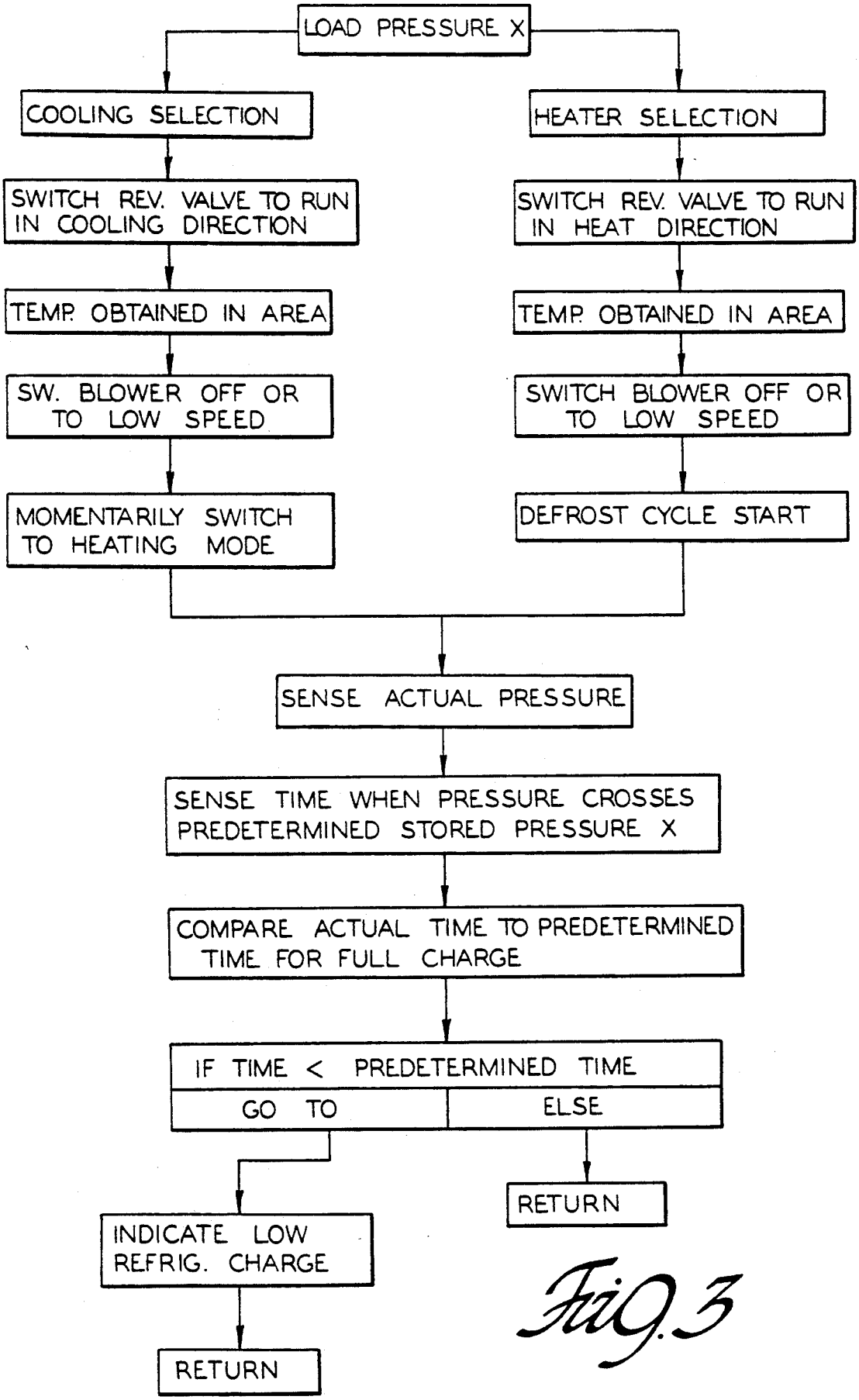
FIG. 3 is a flow chart of the method of the subject invention.

The computer 36 follows the flow chart of FIG. 3 having a cooling selection mode 42 and a heating selection mode 44. While the pressure sensing device can be mounted on either the compressor suction line 30 or discharge line 32 to sense the pressure therein, the controller of the present invention will be described as sensing pressure in discharge line 32. A predetermined pressure value is selected below which the pressure curve will fall when the reversing valve 22 changes position. The predetermined pressure value X is permanently stored in a register 39 of the computer 36 to serve as a permanent reference point. During either the cooling selective mode 42 or heating selective mode, the pressure is sensed (46). The computer 36 receives the sensed pressure signal and determines the amount of time that the actual sensed pressure is below the predetermined reference pressure value. The time at which the pressure value is below the value is compared to a predetermined minimum time in which pressure should drop below when there is a full refrigerant charge. When the actual measured time is less than the predetermined minimum time, the low charge warning signal is set. This logic is reversed if the sensor 34 is placed in the suction line 30.

Figure 2:
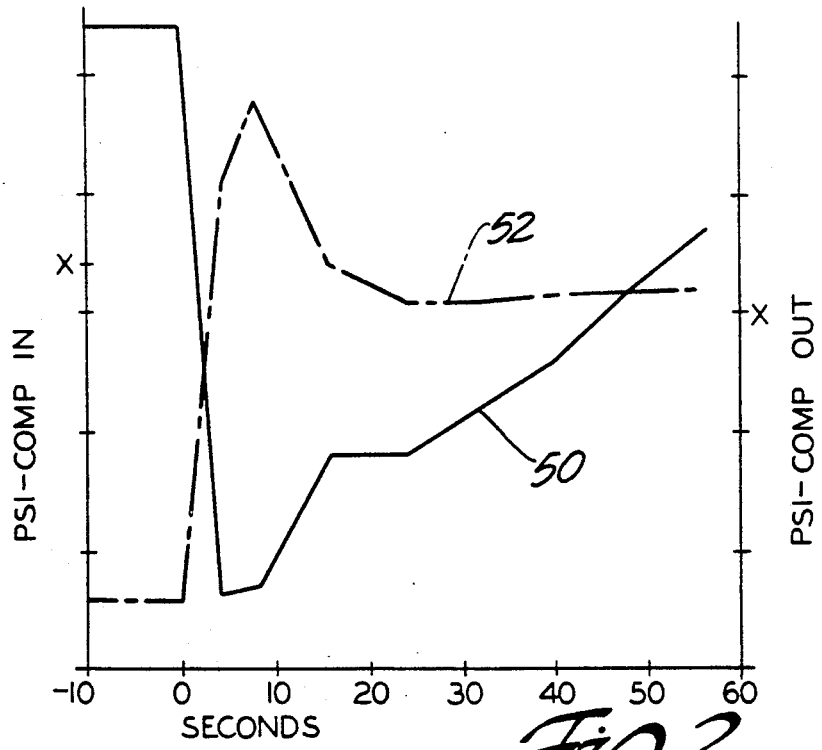
FIG. 2 is a graph of the pressures and time interpreted for the refrigerant monitoring of the subject invention.

In the graph of FIG. 2, the solid line 50 indicates the graph of the normal predetermined pressure sensed in the discharge line 32, and the dotted line 52 indicates the graph of the normal pressure sensed in the suction line 30 with full refrigerant charge. At 0 seconds, the reversing valve 22 is switched. As the graph indicates, there is a fluctuation prior to the system restabilizing.

The amount of time that the system actually takes to restabilize is calculated by the computer 36 by determining when the pressure X is first exceeded and counting the time period the actual discharge pressure remains below the pressure X. The amount of time that the pressure detected on the discharge line 32 remains below pressure X is compared to a standard, previously determined value. A test was conducted by sensing the pressure on the suction line 30. The test occurred at 45° F., 30 mph with 1 kW to the compressor 14. Heating mode was then switched to cooling mode. The normal time for full refrigerant charge pressure stabilization on the suction or inlet was 11 seconds at 2.0–2.5 lbs of refrigerant charge. If the measured time is less than 11 seconds, low refrigerant charge is indicated. With 1.75 lbs of refrigerant charge, stabilization takes 9 seconds—with 1.5 lbs of refrigerant charge, stabilization takes 7 seconds.

The invention also includes a method of detecting low refrigerant charge in a heat pump system 12 of a type having the compressor 14 operatively connected to the reversing valve 22. The method includes the steps of sensing the pressure of refrigerant at a fluid line 30,32 of the compressor 14, detecting the switch time at which the sensed pressure exceeds or drops below a first predetermined pressure value in response to reversal of the reversing valve 22 and reversal of the fluid flow direction, detecting an equilibrium time at which the sensed pressure recrosses a second predetermined pressure value, and indicating a low refrigerant charge in the heat pump system when the time difference between the switch and equilibrium time drops below a predetermined value. It is to be understood that the first and second predetermined pressure values may be the same, in which case the step will provide detecting the time period that the sensed pressure crosses a predetermined switching pressure in response to reversal of the fluid flow direction by reversing the reversing valve.

As heat pump systems 12 are applied to motorized vehicles, there is an increased need to use some type of elastomeric hose material. This hose material is needed to accommodate vibration and relative motion changes that are commonly seen in vehicle applications. The hose material is more prone to leaks than a solid brass or aluminum plumbed system. This drives the need for an active low charge detection system of the subject invention.

The invention has been described in an illustrative manner, and it is to be understood that the terminology which has been used is intended to be in the nature of words of description rather than of limitation.

Obviously, many modifications and variations of the present invention are possible in light of the above teachings. It is, therefore, to be understood that within the scope of the appended claims the invention may be practiced otherwise than as specifically described.

The embodiments of the invention in which an exclusive property or privilege is claimed are defined as follows:

1. A method of detecting low refrigerant charge in a heat pump system of the type having a compressor operatively connected to a reversing valve, the method including the steps of:

sensing the pressure of the refrigerant at a fluid line of the compressor, detecting a first time at which the sensed pressure crosses a first predetermined pressure value in response to reversal of the reversing value and reversal of the fluid flow direction, detecting a second time at which the sensed pressure crosses a second predetermined pressure value, and indicating a low refrigerant charge in the heat pump system when the time difference between the first and second times crosses a predetermined value.

2. A method of detecting low refrigerant charge in a heat pump system of the type having a compressor operatively connected to a reversing valve, the method including the steps of:

sensing the pressure of the refrigerant flowing in one fluid line of the compressor connected to the reversing value, detecting the time period that the sensed pressure crosses a predetermined switching pressure in response to reversal of the fluid flow direction by reversing the reversing valve, indicating a low refrigerant charge in the heat pump system when the time period crosses a predetermined value.

3. A detection apparatus for detecting low refrigerant charge in a heat pump system of the type having a compressor operatively connected by fluid lines to a reversing value and including an evaporator and expansion device and condenser, said apparatus comprising;

pressure sensing means operatively connected to a fluid line of the compressor for sensing the pressure of refrigerant flowing in the fluid line to produce a pressure signal indicative thereof, computer means for receiving said pressure signal and for determining the time period that the sensed pressure crosses a predetermined switching pressure in response to reversal of the fluid flow direction by reversing the reversing value and for producing a warning signal; and indicating means for receiving said warning signal and for producing an indication of low refrigerant charge.

* * * * *